US011036185B2

(12) United States Patent
Zaugg et al.

(10) Patent No.: US 11,036,185 B2
(45) Date of Patent: Jun. 15, 2021

(54) TIMEPIECE MECHANISM FOR DISPLAYING THE LUNAR DAY AND MOON PHASE, WITH A CORRECTION SYSTEM USING A DOUBLE KINEMATIC CHAIN

(71) Applicant: Montres Breguet S.A., L'Abbaye (CH)

(72) Inventors: Alain Zaugg, Le Sentier (CH); Christophe Riedo, Le Lieu (CH)

(73) Assignee: Montres Breguet S.A., L'Abbaye (CH)

( * ) Notice: Subject to any disclaimer, the term of this patent is extended or adjusted under 35 U.S.C. 154(b) by 460 days.

(21) Appl. No.: 16/170,228

(22) Filed: Oct. 25, 2018

(65) Prior Publication Data

US 2019/0146414 A1 May 16, 2019

(30) Foreign Application Priority Data

Nov. 10, 2017 (EP) ..... 17201110

(51) Int. Cl.
*G04B 19/26* (2006.01)

(52) U.S. Cl.
CPC ..... *G04B 19/268* (2013.01)

(58) Field of Classification Search
CPC ..... G04B 19/26; G04B 19/262; G04B 19/268
See application file for complete search history.

(56) References Cited

U.S. PATENT DOCUMENTS 7,859,948 B2 * 12/2010 Plomb ..... G04B 47/044 368/16
2014/0126336 A1 5/2014 Goeller et al.

FOREIGN PATENT DOCUMENTS

| | | | | |
|---|---|---|---|---|
| CH | 697674 B1 * | 1/2009 | ..... | G04B 19/268 |
| EP | 0 566 529 A1 | 10/1993 | | |
| EP | 2 687 918 A1 | 1/2014 | | |
| EP | 2 728 420 A1 | 5/2014 | | |
| WO | WO 91/11756 A1 | 8/1991 | | |
| WO | WO-9111756 A1 * | 8/1991 | ..... | G04B 19/268 |

OTHER PUBLICATIONS

European Search Report dated May 24, 2018 in European Application 17201110.8 filed on Nov. 10, 2017 (with English Translation of Categories of Cited Documents).

Glaser, G. "Astronomische Indikationen Bei Uhren",Jahrbuch Der Deutschen Gesellschaft Fur Chronometrie, Deutschen Gesellschaft Fur Chronometrie E.V. Stuttgart, DE, vol. 40, ISSN: 0373-7616, 1989, pp. 24.

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

Timepiece mechanism for displaying the lunar day and the moon phase. The moon is represented by a sphere mounted on a meridian wheel and includes a first rotating element meshed with a drive mechanism, a second rotating element friction mounted on the first rotating element, a moon wheel set coupling the first rotating element to the meridian wheel, a transmission wheel with a jumper spring, a system for correcting the lunar day display via a first correction wheel bypassing the transmission wheel and including the meridian wheel, a system for correcting the lunar day display via a second correction wheel including the transmission wheel.

15 Claims, 7 Drawing Sheets

TIMEPIECE MECHANISM FOR DISPLAYING THE LUNAR DAY AND MOON PHASE, WITH A CORRECTION SYSTEM USING A DOUBLE KINEMATIC CHAIN

CROSS-REFERENCE TO RELATED APPLICATION

This application claims priority of European Patent Application No. 17201110.8 filed on Nov. 10, 2017 the entire disclosure of which is incorporated herein by reference.

FIELD OF THE INVENTION

The invention concerns the field of horology. It concerns, more specifically, a mechanism, commonly called an astronomical complication, which allows the display of both:

- the lunar day, whose duration separates two successive crossings of a given meridian (which may be represented, in the clock or watch provided with the mechanism, by two successive midday crossings);
- and the moon phase, i.e. the (variable) portion of the moon illuminated by the sun.

BACKGROUND OF THE INVENTION

The astronomical features of the moon have been known for a long time and are notably described by James Ferguson in "Astronomy explained upon Sir Isaac Newton's principles", the fifth edition of which was published in 1772.

The mean value of the lunar day (separating two crossings of the meridian) is 24 hours, 50 minutes and 28.328 seconds.

The solar day to lunar day ratio is thus:

$$\frac{86400\ s}{89428.328\ s} = 0.96613682$$

As for the mean value of the lunation (the duration separating two full moons), this is 29 days, 12 hours, 44 minutes and 2.8 seconds.

Claiming to be inspired by Ferguson, E. Cloux, in his Horology course given at the Technical College of the Vallee de Joux (Switzerland) in 1949, drew a lunar day and moon phase display mechanism, in superposition on the solar day (with a mean value of 24 hours).

The mechanism drawn by E-Cloux, represented in FIG. 1, included the following elements:

- a moon bearing 101 provided with a meridian wheel 102 (with 59 teeth) and rotatably mounted about a main axis X1;
- a sphere 103 representing the moon, rotatably mounted relative to moon bearing 101 about a radial axis X2 perpendicular to main axis X1; radial axis Y1 carries a moon pinion 104 (with 20 teeth);
- a first rotating element 105 (with 57 teeth) rotatably mounted about main axis X1 and which, it is understood, must mesh with a drive mechanism (not represented) also employed for displaying the minutes and/or hours of the solar day;
- a moon wheel set 106 (with two integral wheels each with 57 teeth) rotationally coupling, with gear reduction, first rotating element 105 to meridian wheel 102;
- a central wheel 107 (with 20 teeth), integral with first rotating element 105 and meshing with moon pinion 104.

This ingenious mechanism makes it possible to display the moon crossing the meridian in 24 hours, 50 minutes, 31.58 seconds, and a lunation in 29.5 days.

It is seen that these are approximations of the mean lunar day and the mean lunation, imposed by the choice of gear ratio:

$$24\ h > 59/57 = 24\ h\ 50\ \text{min}\ 31.58\ s$$

However, the mechanism drawn by E. Cloux has no member for making corrections to the display that are made necessary either by deviations resulting from the aforecited approximations, or, quite simply, by the mechanism stopping once the power source is depleted (usually a mainspring in mechanical watches, which, if not rewound will unwind completely).

Consequently, it is an object of the invention to propose a solution which makes it possible to correct, in a simple and reliable manner, the lunar day and lunation in the mechanism presented above.

SUMMARY OF THE INVENTION

To achieve the aforecited object, there is proposed a timepiece mechanism for displaying the lunar day and the moon phase, which includes:

- a first rotating element rotatably mounted about a main axis and meshing with a drive mechanism,
- a moon bearing provided with a meridian wheel and rotatably mounted about a main axis,
- a sphere representing the moon, rotatably mounted relative to the moon bearing about a radial axis perpendicular to the main axis, the radial axis carrying a moon pinion,
- a moon wheel set rotationally coupling, with gear reduction, the first rotating element to the meridian wheel,
- a central wheel, rotatably mounted about a main axis on the first rotating element and meshing with the moon pinion,
- a second rotating element, meshing with the moon wheel set and friction mounted, at an interface, on the first rotating element to rotate integrally therewith about the main axis while the torque resulting from various circumferential forces respectively exerted on the first rotating element and on the second rotating element is lower, than a friction torque determining the maximum adhesion force at the interface, the second rotating element together with the moon wheel set and the moon bearing forming a first kinematic chain downstream of the first rotating element,
- a transmission wheel, integral in rotation with the central wheel and provided externally with a toothing and internally with at least one jumper spring engaging and meshing with the toothing of a star wheel integral in rotation with the second rotating element, to rotationally couple said second rotating element to the central wheel while the torque resulting from the various circumferential forces exerted respectively on the star wheel and on the transmission wheel is lower than a jump torque, beyond which the jumper spring is radially shifted by sliding over the star wheel until it is disengaged therefrom, said at least one jumper spring and the star wheel being configured such that the jump torque is lower than said friction torque, the transmission wheel together with the central wheel and the moon pinion forming a second kinematic chain downstream of the star wheel, a system for correcting the lunar day display, which includes a first drive element capable of having, at least momentarily, a meshing relationship with the first kinematic chain in order to force rotation of the moon bearing about the main axis, via a first correction train partially formed by at least one portion of the first kinematic chain, when a first correction torque, greater than said friction torque, is applied to said first correction train by a user, and a system for correcting the moon phase, which includes a second drive element capable of having, at least momentarily, a meshing relationship with the second kinematic chain in order to force rotation of the sphere about said radial axis, via a second correction train partially formed by at least one portion of the second kinematic chain and independent of the first kinematic chain, when a second correction torque, greater than said jump torque, is applied to said second correction train by a user.

As a result of this double correction system, which acts by using two distinct kinematic chains, it is possible to correct, in a simple and reliable manner, the lunar day display and the moon phase display.

According to a main embodiment, the lunar day display correction system and the moon phase correction system include a joint correction device for activating the lunar day display and, without activating the lunar day display, the moon phase. This joint correction device includes a sliding pinion which alone forms the first and second drive elements, said sliding pinion being able to adopt two adjustment positions, namely:

a lunar day adjustment position, in which the sliding pinion meshes with the moon wheel set to force rotation of the moon bearing about said main axis via said at least one portion of the first kinematic chain;

a moon phase adjustment position, in which the sliding pinion meshes with the transmission wheel to force rotation of the sphere about said radial axis via said at least one portion of the second kinematic chain.

The correction device advantageously includes a carrier pinion which meshes with the sliding pinion and at least one small connecting rod which joins the axes of rotation of the sliding pinion and of the carrier pinion.

The first rotating element includes, for example, a toothed wheel which extends perpendicularly to the main axis, integral with a pipe which extends along the main axis. The second rotating element then includes an auxiliary wheel which extends perpendicularly to the main axis, integral with a sleeve which is friction fitted onto the pipe of the first rotating element.

The friction connection between the second rotating element and the first rotating element is advantageously achieved by indenting, which for example takes the form of a one-off deformation of the internal diameter of the tube of the second rotating element, in order to ensure friction on the conical slot made in the pipe of the first element.

According to a preferred embodiment, the moon wheel set includes two superposed integral wheels, namely:

a lower wheel, which meshes with the auxiliary wheel of the second rotating element, and an upper wheel, which meshes with the meridian wheel of the moon bearing.

According to a particular embodiment:

the auxiliary wheel of the second rotating element has 64 teeth, the lower wheel of the moon wheel set has 43 teeth, the upper wheel of the moon wheel set has 37 teeth, and the meridian wheel of the moon bearing has 57 teeth.

The central wheel preferably carries a crown toothing meshed with the moon pinion; further, the central wheel is advantageously fitted onto the pipe of the first rotating element.

The moon bearing is preferably mounted on the central wheel, for example, fitted onto the latter with the insertion of a smooth bearing.

The transmission wheel advantageously includes a pair of diametrically opposite jumper springs.

Finally, the star wheel typically has 29 or 30 teeth, or, in a preferred variant, 59 teeth.

BRIEF DESCRIPTION OF THE DRAWINGS

Other features and advantages of the invention will appear in light of the following description of one embodiment, made with reference to the annexed drawings, in which.

DETAILED DESCRIPTION OF THE INVENTION

Figure 1:
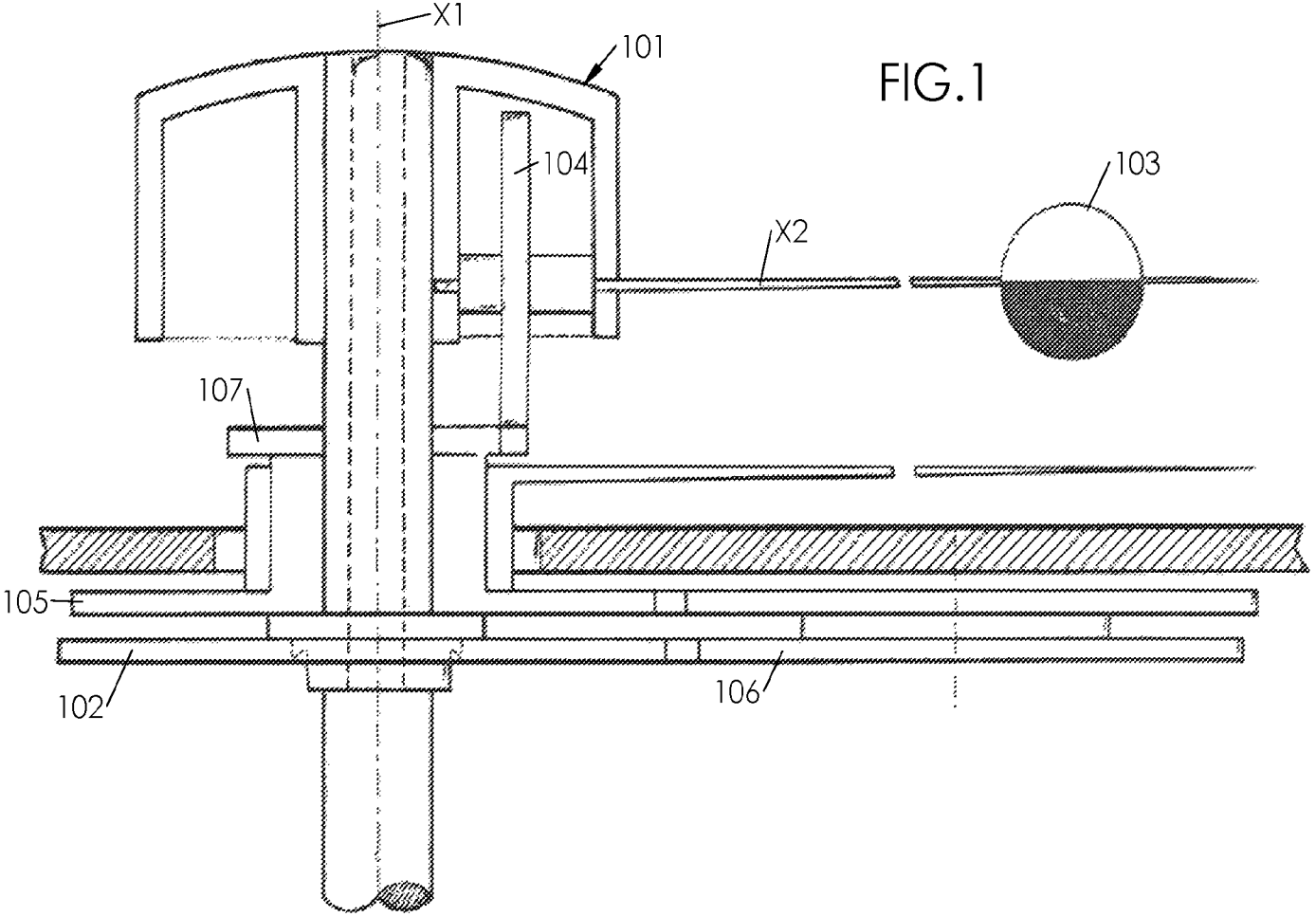
FIG. 1 is a cross-sectional view of a known mechanism for displaying the lunar day and moon phase, as proposed by E. Cloux.
Figure 2:
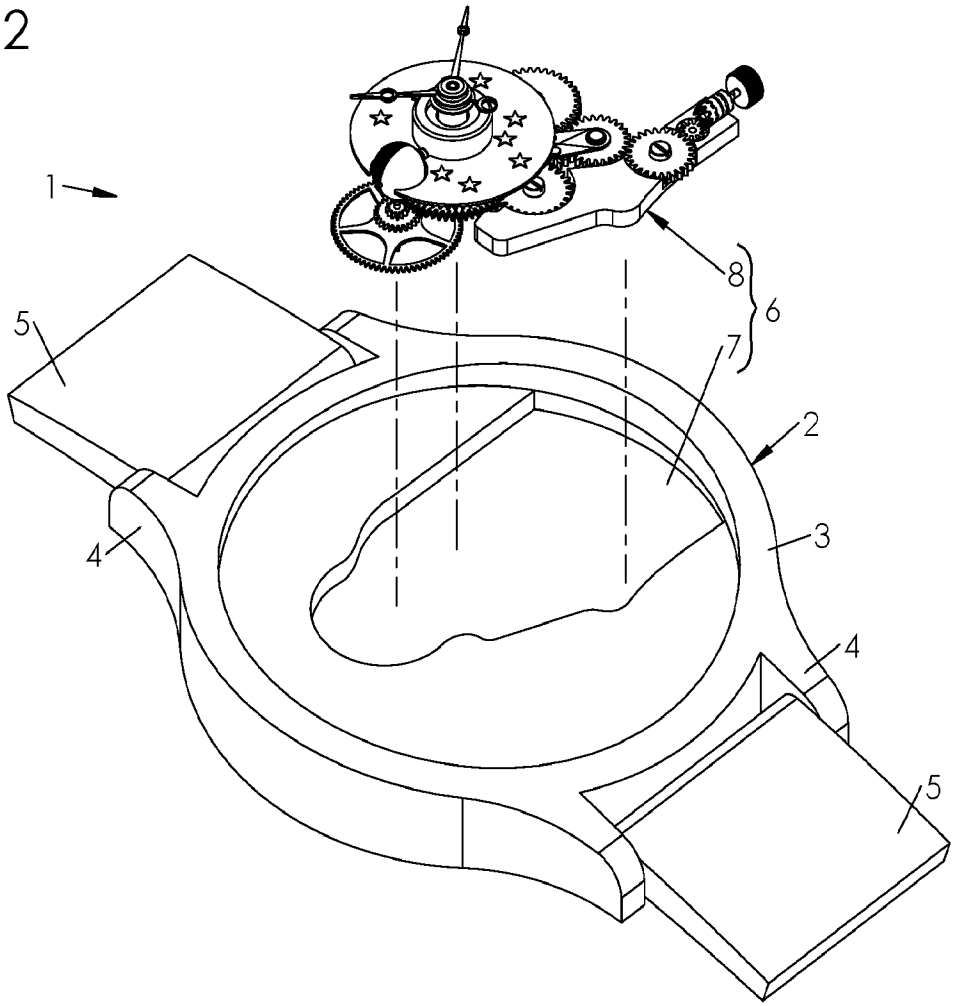
FIG. 2 is an exploded perspective view illustrating a watch provided with a mechanism for displaying the lunar day and moon phase according to the invention.

FIG. 2 represents a timepiece. This could be a clock or a pendulum clock, but, in the illustrated example, it is a watch 1—and more precisely a wristwatch, able to be worn on the wrist. In a conventional manner, this watch 1 includes a case 2 which includes a case middle 3, a back cover and a crystal (not represented), and, fixed to the horns 4 of the case middle, a bracelet 5 for wear on the wrist.

Watch 1 includes, housed inside case 2, a timepiece movement which includes a bottom plate 7 and, mounted on the plate, at least one timepiece mechanism 8 designed to ensure display of the lunar day and moon phase.

As we will see, mechanism 8 is also designed to ensure display of the minutes and hour of the mean solar day but such a display is optional and could be provided by a separate mechanism.

Mechanism 8 belongs to the family of 'astronomical' complications; it is organised around a main axis A1 perpendicular to the general plane of plate 7.

The moon is displayed as a body, in the form of a sphere 9 driven in a double movement:

revolution about main axis A1 to provide the lunar day indication;

rotation about a specific (radial) axis A3 to provide the moon phase indication.

Figure 4:
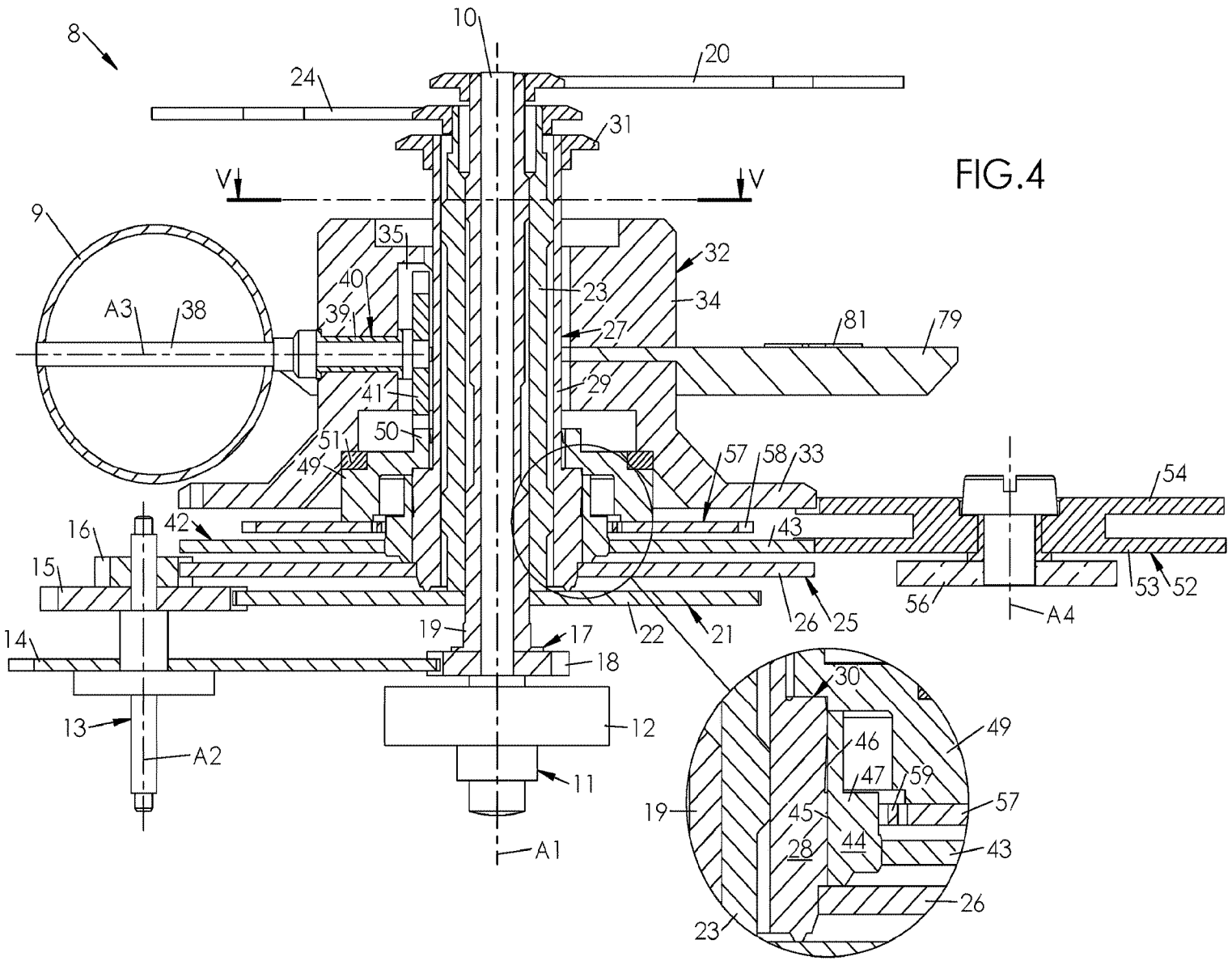
FIG. 4 is a partial cross-sectional view of the mechanism of FIG. 3, along the cross-sectional plane IV-IV; an inset shows a larger scale detail.

According to an embodiment illustrated in FIG. 4, main axis A1 is materialized by an arbor 10 which, in this example, is formed on a centre wheel set 11, which is itself mounted on plate 7. This central wheel set is provided here with a wheel 12 whose function is not relevant to the present context.

As seen in FIG. 4, display mechanism 8 is engaged by a drive mechanism 13, hereafter referred to as the motion-work, which includes several superposed rotationally integral wheels with a common axis A2 which is offset relative to main axis A1 and parallel thereto. In the illustrated example, motion-work 13 includes three superposed wheels, namely:

- a large wheel 14, provided with a peripheral toothing typically having a number of teeth Z1=72;
- a medium wheel 15, provided with a peripheral toothing typically having a number of teeth Z2=24;
- a small wheel 16, provided with a peripheral toothing typically having a number of teeth Z3=12.

Motion-work 13 is driven in rotation by a drive device (not represented) including an energy source and a transmission. As astronomical complications are usually associated with mechanical watches, it is preferable for the energy source to be a mainspring associated with a balance/balance spring regulator. Nevertheless, if the energy source were a battery associated with a quartz resonator it would not be outside the scope of the invention.

As already mentioned, mechanism 8 is designed to display the minutes and the hour of the mean solar day.

For the minute display, mechanism 8 includes a cannon pinion 17, rotatably mounted about main axis A1 and provided with a centre pinion 18 meshing with large wheel 14, and with a tube 19 fitted (with the possibility of rotation) onto arbor 10 of centre wheel set 11. Cannon pinion 17 carries a minute hand 20 which, as illustrated in FIG. 4, is pressed onto tube 19, at an upper end of the latter. Centre pinion 18 is provided with a peripheral toothing typically including a number of teeth Z4=16. Cannon pinion 17 makes one revolution about main axis A1 in one hour.

For the hour display, mechanism 8 includes an hour wheel set 21, rotatably mounted about main axis A1 and provided with an hour wheel 22 meshing with medium wheel 15, and a hollow shaft 23 fitted (with the possibility of rotation) onto tube 19 of cannon pinion 17. Hour wheel set 21 carries an hour hand 24 which, as illustrated in FIG. 4, is driven onto hollow shaft 23, at an upper end of the latter.

Hour wheel 22 is provided with a peripheral toothing typically having a number of teeth Z5=64, such that the gear reduction ratio (i.e. the ratio of rotational speeds) between hour wheel 22 and centre pinion 18 is:

$$\frac{Z4}{Z1} \times \frac{Z2}{Z5} = \frac{16}{72} \times \frac{24}{64} = \frac{1}{12}$$

Consequently, hour wheel set 21 makes one revolution about main axis A1 in 12 hours.

For the lunar day and moon phase display, mechanism 8 includes, firstly, a first rotating element 25 rotatably mounted about main axis A1 and meshing with motion-work 13.

More specifically, in the example illustrated, in particular, in FIG. 4, first rotating element 25 includes a toothed wheel, called solar wheel 26 (or 24-hour wheel), which extends perpendicularly to main axis A1, and a pipe 27, integral with the solar wheel and which extends along main axis A1. According to one embodiment illustrated in FIG. 4, pipe 27 is fitted (with the possibility of rotation) onto hollow shaft 23 of hour wheel set 21.

In the illustrated example, pipe 27 is tiered, and includes a lower tier 28, integral with solar wheel 26, and an upper tier 29, of smaller diameter than that of tier 28. The lower tier and the upper tier are separated by a shoulder 30.

Solar wheel 26 meshes with small wheel 16 of motion-work 13. This solar wheel is provided with a peripheral toothing typically having a number of teeth Z6=64, such that the gear reduction ratio between first rotating element 25 and hour wheel set 21 is:

$$\frac{Z5}{Z2} \times \frac{Z3}{Z6} = \frac{64}{24} \times \frac{12}{64} = \frac{1}{2}$$

Consequently, first rotating element 25 makes one revolution about main axis A1 in 24 hours. In other words, the first rotating element can be used to measure the mean solar day. It can also be employed to display the mean solar day. Thus, in the illustrated embodiment (cf. FIG. 3), the first rotating element carries, at an upper end of upper tier 29 of pipe 27, a solar hand 31 (also called a 24-hour hand), which may be round in shape and/or have a circular opening to represent the sun.

Mechanism 8 includes, secondly, a moon bearing 32 rotatably mounted about main axis A1. The moon bearing is provided with a meridian wheel 33. The moon bearing is also provided with a moon cover 34, fixed to the meridian wheel to rotate integrally therewith. In a variant, the meridian wheel and the moon cover form a one-piece part.

Meridian wheel 33 is provided with a peripheral toothing typically having a number of teeth Z7=57.

As seen in FIG. 4, moon bearing 32 is hollow, and has an internal cavity 35 arranged inside moon cover 34.

Mechanism 8 includes, thirdly, a sphere 9 representing the moon, rotatably mounted relative to moon bearing 32 about a radial axis A3 perpendicular to main axis A1. Sphere 9 advantageously has two hemispheres of contrasting colours, namely:

- a dark hemisphere 36 (grey in the drawings), representing the portion of the side of the moon not illuminated by the sun;
- a light coloured hemisphere 37 (white in the drawings), representing the portion of the moon illuminated by the sun.

Hemispheres 36, 37 can be made distinct by applying paint. However, in a preferred embodiment, the hemispheres are half-spherical calottes made from different materials and assembled to form sphere 9. Thus, dark hemisphere 36 can be made from biotite mica, obsidian or any other dark mineral, while light hemisphere 37 can be made of metal (for example silver or grey gold), or from a light-coloured mineral (for example moonstone).

Further, in the illustrated example, radial axis A3 is formed by a runner 38 that passes through sphere 9 and rotates integrally therewith. At an inner end, the runner is mounted in a sleeve 39 fitted into a hole 40 made in moon bearing 32.

As seen in FIG. 4, radial axis A3 (i.e. runner 38) carries, at an inner end, a moon pinion 41, which is rotates integrally therewith. The moon pinion is housed inside inner cavity 35 of moon bearing 32.

Moon pinion 41 is provided with a peripheral toothing typically having a number of teeth Z8=14.

Mechanism 8 includes, fourthly, a second rotating element 42, rotatably mounted about main axis A1. According to an embodiment illustrated in FIG. 4, the second rotating element includes an auxiliary wheel 43, which extends perpendicularly to main axis A1, and a sleeve 44 integral with the auxiliary wheel and which extends along main axis A1. Auxiliary wheel 43 is provided with a peripheral toothing typically having a number of teeth Z9=64 teeth.

Second rotating element 42 is mounted on first rotating element 25 with friction at their interface, referenced 45 (the interface is the surface where the first rotating element and the second rotating element make contact).

More precisely, sleeve 44 is friction fitted onto pipe 27 of the first rotating element. Even more precisely, the sleeve is friction fitted onto the lower tier 28 of the pipe. This friction fit is intended to make second rotating element 42 integral (in rotation about main axis A1) with first rotating element 25, while the torque, referenced C1, resulting from various circumferential forces respectively exerted on the first rotating element and on the second rotating element is lower than a friction torque, referenced CF, which determines the maximum adhesion force at interface 45.

In other words:

- while C1<CF, first rotating element 25 and second rotating element 42 rotate integrally, with no sliding at their interface 45, and behave like a one-piece part;
- as soon as C1≥CF, the maximum adhesion force at interface 45 between first rotating element 25 and second rotating element 42 is reached, and they become rotationally separate, such that the second rotating element can pivot independently of the first rotating element about main axis A1, with sliding at interface 45.

The friction connection at interface 45 between the second rotating element and the first rotating element can, in practice, be achieved by an indent 46, which takes the form, for example, as illustrated in the detailed inset of FIG. 4, of a conical groove made in pipe 27 of the first rotating element.

Second rotating element 42 is provided with a star wheel 47. This peripherally formed star wheel 47, is, for example, cut externally in sleeve 44. It includes a series of triangular teeth 48, which are 30 in number here, but could be 29 in number, or even 59 in number (which is the approximate number of half-days in one lunation).

Mechanism 8 includes, fifthly, a central wheel 49, mounted on first rotating element 25 and geared with moon pinion 41. This central wheel advantageously carries a crown toothing 50 (i.e. whose teeth extend parallel to main axis A1) meshed with moon pinion 41. This toothing is, for example, cycloidal and has a number of teeth Z10 equal to the number of teeth Z8 of the moon pinion (namely Z10=14 here).

In the example illustrated in FIG. 4, central wheel 49 is fitted onto pipe 27 of first rotating element 25. More precisely, the central wheel is fitted onto shoulder 30. The interface between the central wheel and the first rotating element is a sliding interface, so that the central wheel can rotate independently of the first rotating element.

According to a preferred embodiment illustrated in FIG. 4, moon bearing 32 is mounted on central wheel 49. To allow rotation of moon bearing 32 relative to the central wheel, a smooth bearing 51 is inserted therebetween.

Mechanism 8 includes, sixthly, a moon wheel set 52 which rotationally couples, with gear reduction, first rotating element 25 to meridian wheel 33 (and thus to moon bearing 32) to allow the moon bearing to be rotated by first rotating element 25. More precisely, moon wheel set 52 rotationally couples second rotating element 42 (integral in rotation with first rotating element 25 while C1<CF) to the meridian wheel.

Moon wheel set 52 is offset, rotatably mounted about an axis A4 parallel to main axis A1. According to an embodiment illustrated in FIG. 4, the moon wheel set includes two superposed integral wheels, namely:

- a lower wheel 53, which meshes with auxiliary wheel 43 of second rotating element 42;
- an upper wheel 54, which meshes with meridian wheel 33 of moon bearing 32.

Lower wheel 53 is provided with a peripheral toothing typically having a number of teeth Z11=43. Upper wheel 54 is provided with a peripheral toothing typically having a number of teeth Z12=37 teeth. Consequently, the gear reduction ratio, referenced R, of solar wheel 26 to meridian wheel 33 (equal to the rotational speed ratio of moon bearing 32 to first rotating element 25) is:

$$R = \frac{Z9}{Z11} \times \frac{Z12}{Z7} = \frac{64}{43} \times \frac{37}{57} = 0.96613627$$

This gear reduction ratio provides the displayed mean lunar day value, referenced J:

$$J = \frac{24\text{ h}}{R} = 24\text{ h } 50\text{ min } 28.378\text{ s}$$

This is an excellent approximation of the real mean lunar day. Indeed, the lunar day displayed shows a loss of only 5/100ths of a second per solar day relative to the real lunar day (i.e. one day of loss every eight years).

The lunar day display is ensured by the circular path (i.e. the revolution) of sphere 9 about main axis A1. The moon crossing the zenith is represented by sphere 9 crossing twelve o'clock.

Figure 3:
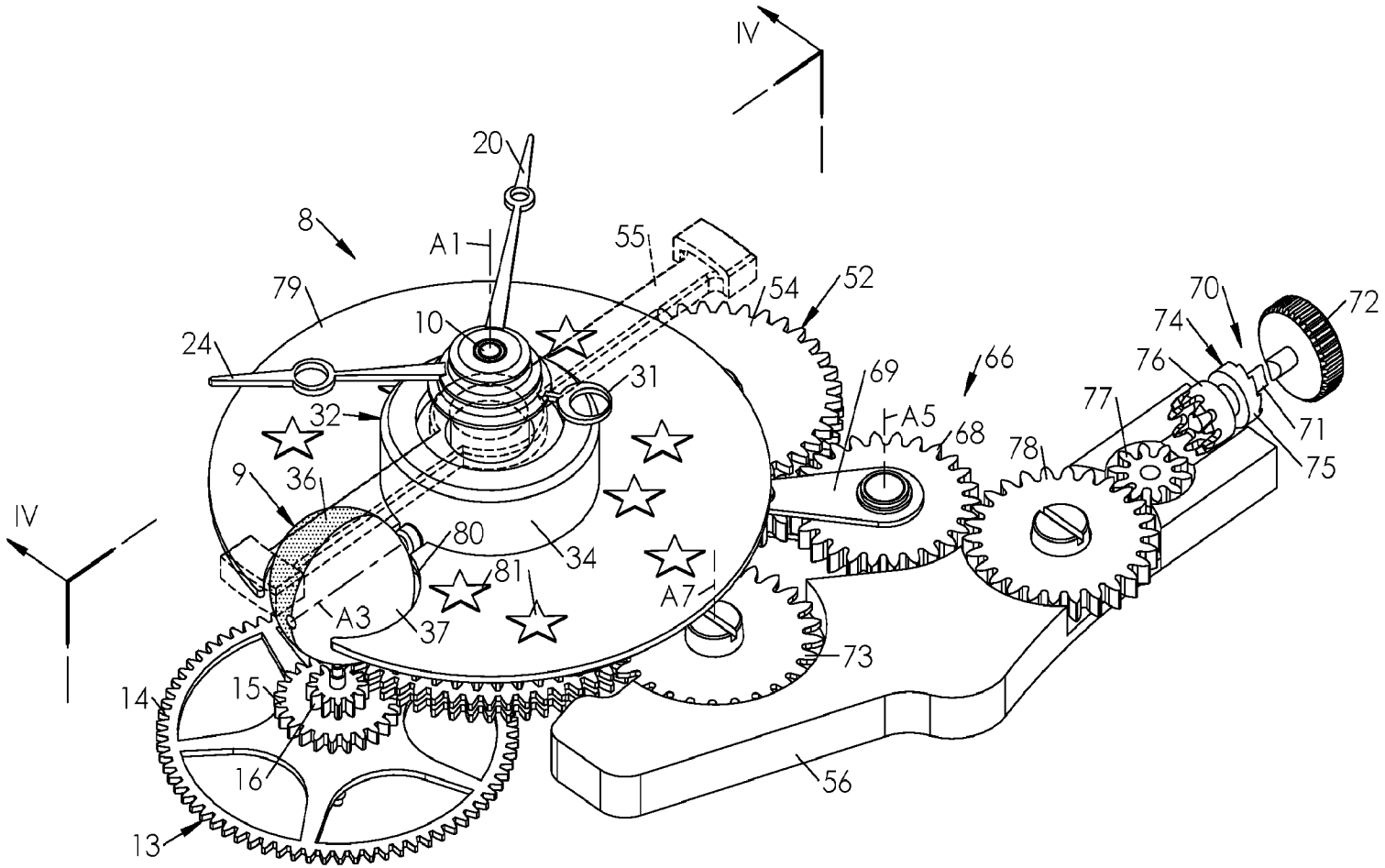
FIG. 3 is a perspective, larger scale view of the display mechanism of FIG. 2.

According to a preferred embodiment, illustrated in dotted lines in FIG. 3, the watch is advantageously provided with a bar 55, visible to the wearer, and which represents the earth's horizon line.

The path of approximately 180° of sphere 9 above bar 55 (from the point of view of the wearer) represents the moon's path in the visible sky (lunar day), while the path of approximately 180° of sphere 9 below the bar represents the moon's path in the non-visible sky (lunar night).

Moon wheel set 52 is advantageously mounted on a bridge 56 which is itself fixed to plate 7. Its axis of rotation A4 is, for example, materialized by a screw in helical engagement with bridge 56.

Mechanism 8 includes, seventhly, a transmission wheel 57 integral with central wheel 49, designed to make the latter rotate integrally with second rotating element 42 during normal operation of mechanism 8, and conversely, to allow rotation of one relative to the other when the display is corrected, in conditions which will be set out below.

Transmission wheel 57 is provided externally with a toothing 58 and internally with at least one jumper spring 59.

Figure 8:
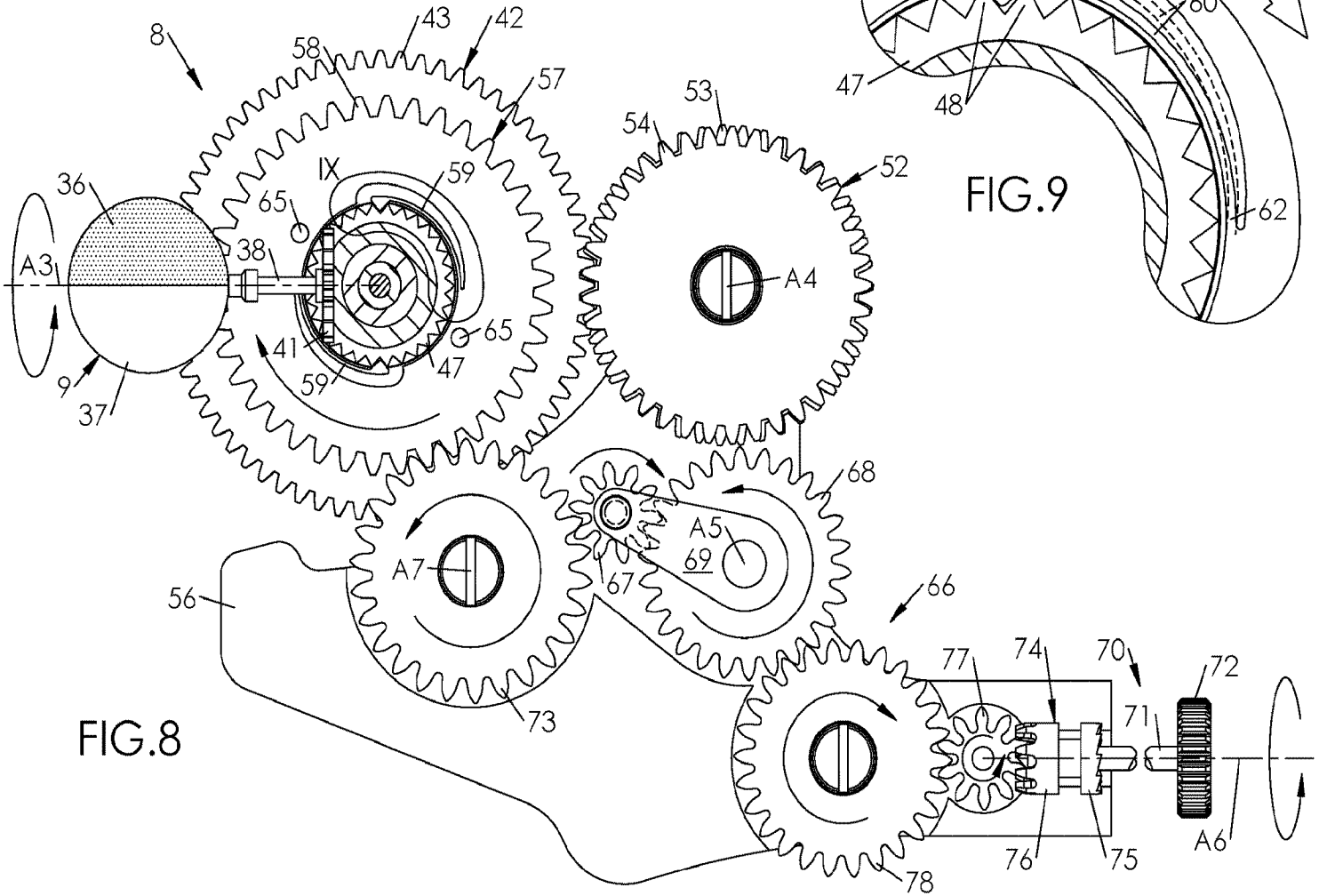
FIG. 8 is a similar view to that of FIG. 5 illustrating the moon phase correction.

According to an embodiment illustrated in FIG. 8, transmission wheel 57 is provided with a pair of diametrically opposite jumper springs 59. This number is not limiting. Thus, three jumper springs arranged at 120° could be provided.

Figure 6:
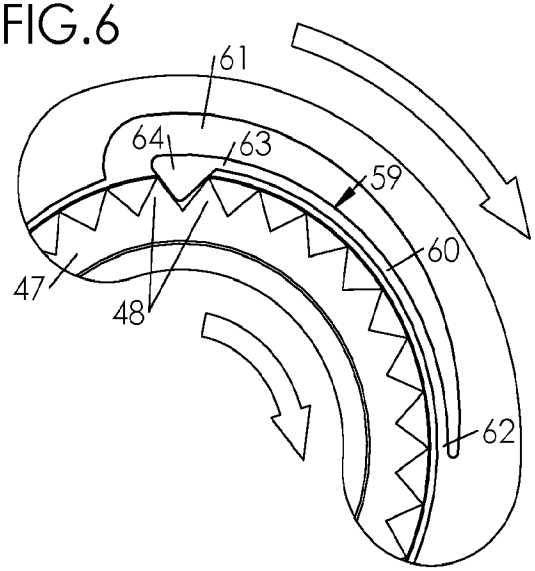
FIG. 6 is a larger scale view of a detail of the mechanism, taken at the same time in inset VI at the top left of FIG. 5.
Figure 9:
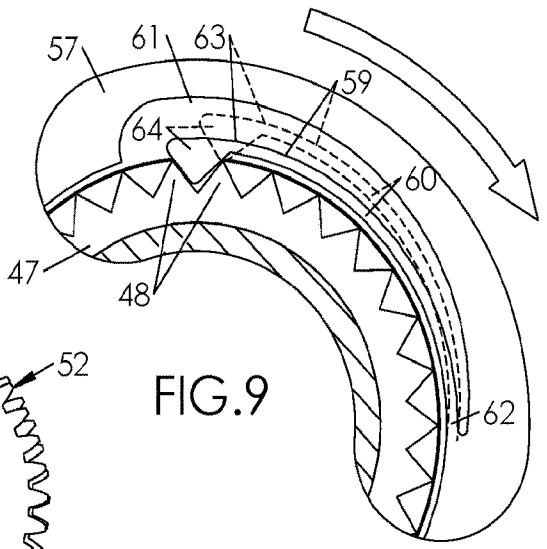
FIG. 9 is a larger scale view of a detail of the mechanism, taken in inset IX at the top left of FIG. 8.

As illustrated in FIG. 6 and FIG. 9, the (or each) jumper spring 59 includes a strip spring 60 (curved in the illustrated example), which extends into a hollow 61 made in transmission wheel 57. Seen from above, strip spring 60 extends from a fixed end 61 to a free end 63 in the anticlockwise direction (cf. FIG. 6). Jumper spring 59 is also provided, at the free end of the strip spring, with a triangular head 64 of complementary size and shape to the space separating two adjacent teeth 48 of star wheel 47.

The (or each) jumper spring 59 is engaged and mesh (via its head 64) with the toothing of star wheel 47. In its position of equilibrium (in the absence of any stress), jumper spring 59 would occupy a position in which head 64 is separated from main axis A1 by a distance smaller than the radius of the star wheel.

In normal operation, the (or each) jumper spring 59 is retained by its head 64 between two adjacent teeth 48 of star wheel 47. Jumper spring 59 is held in this position by its own elastic return force which tends to draw head 64 in the direction of main axis A1.

During normal operation, second rotating element 42, which is integral with first rotating element 25 (and thus driven therewith in rotation) rotates about main axis A1 in the clockwise direction (seen from above). Star wheel 47 consequently exerts on head 64 of the (or of each) jumper spring 59 a stress that causes the latter to butt, which tends to keep head 64 between two adjacent teeth 48 of the star wheel. In these conditions, the second rotating element (with the first rotating element) and transmission wheel 57 (with central wheel 49) are integral in rotation about main axis A1 and rotate together in the clockwise direction about the latter (FIG. 6).

Central wheel 49 is made integral with transmission wheel 57, for example by means of feet 65, protruding onto the central wheel, driven into holes made in transmission wheel 57. In a variant, this attachment can be achieved using screws.

During a correction of the moon phase display, a drive torque is applied to transmission wheel 57 to drive it in rotation about main axis A1 (in the anticlockwise direction when seen from above, cf. FIG. 8 and FIG. 9) without, however, this rotation being transmitted by star wheel 47 to second rotating element 42.

Second rotating element 42, friction mounted on first rotating element 25, resists the rotation of transmission wheel 57, and the torque resulting from the various circumferential forces exerted respectively on first rotating element and on transmission wheel 57 is referenced C2.

It is at this point that the elasticity of jumper spring(s) 56 plays a part. Each jumper spring 59 is set—i.e. dimensioned—to:

- remain locked meshed with star wheel 47 while torque C2 is lower than a jump torque CS;
- be radially shifted by sliding over star wheel 47 (and more precisely by head 64 sliding over teeth 48) until it is disengaged, as illustrated in dotted lines in FIG. 9, as soon as torque C2 becomes greater than jump torque CS. It will be noted that this radial shift is permitted by the flexibility of strip spring 60.

Jump torque CS is lower than friction torque CF, i.e.:

$$CS<CF$$

Consequently, the application of torque C2 alone can never cause second rotating element 42 to slide relative to first rotating element 25. The first and second rotating elements therefore remain integral in rotation (and thus immobile) during a moon phase correction.

During normal operation, central wheel 49 (with crown toothing 50) rotates integrally with the second rotating element (and thus with the first rotating element) at a rate of one complete revolution about main axis A1 in 24 hours.

Given gear reduction ratio R presented above, moon bearing 32 (with sphere 9) makes its own complete revolution more slowly (in 24 hours, 50 minutes and 28.378 seconds), And, given the fact that moon pinion 41 and crown toothing 50 include the same number of teeth (Z8=Z10), sphere 9 is driven slowly in rotation about radial axis A3 (in the clockwise direction when mechanism 8 is observed from the side, in the direction of radial axis A3).

Sphere 9 makes one complete rotation about its axis A3 in a number L of days corresponding to the displayed lunation value, i.e.:

$$L=\frac{1}{1-R}=29.53012048=29\ j\ 12\ \text{h}\ 43\ \text{min}\ 22.4\ \text{s}$$

This is an excellent approximation of the real lunation, with a loss of around 7 minutes per month compared to said real lunation (i.e. one day of loss every 17 years).

We have seen that the differences between the displayed lunar day and the real lunar day, on the one hand, and the displayed moon phase and the real moon phase on the other hand, are small. One lunar day correction and one lunation correction would be required after several years of uninterrupted operation of watch 1.

However, users who are diligent enough not to let the power reserve of a mechanical watch become depleted are rare. Thus, corrections required to reset the displays after watch 1 has stopped due to absent-mindedness of the user are more frequent than corrections required to make up losses accumulated by mechanism 8 during uninterrupted operation.

To correct the lunar day display, mechanism 8 is provided with a correction device 66 including a pinion 67 able to mesh with moon wheel set 52 to force rotation of moon bearing 32 about main axis A1 via a first correction train which bypasses transmission wheel 57 and which includes moon wheel set 52 and meridian wheel 33.

To correct the moon phase display, mechanism 8 is provided with a correction device 66 which includes a pinion 67 able to mesh with transmission wheel 57 to force rotation of sphere 9 about radial axis A3 via a second train which includes the transmission wheel, central wheel 49 and moon pinion 41.

Mechanism 8 could have two distinct correction devices to correct the lunar day display and the moon phase display separately. To activate them separately, watch 1 could be provided with two distinct winding mechanisms that could be operated independently of one another by the user (or a watchmaker).

Figure 5:
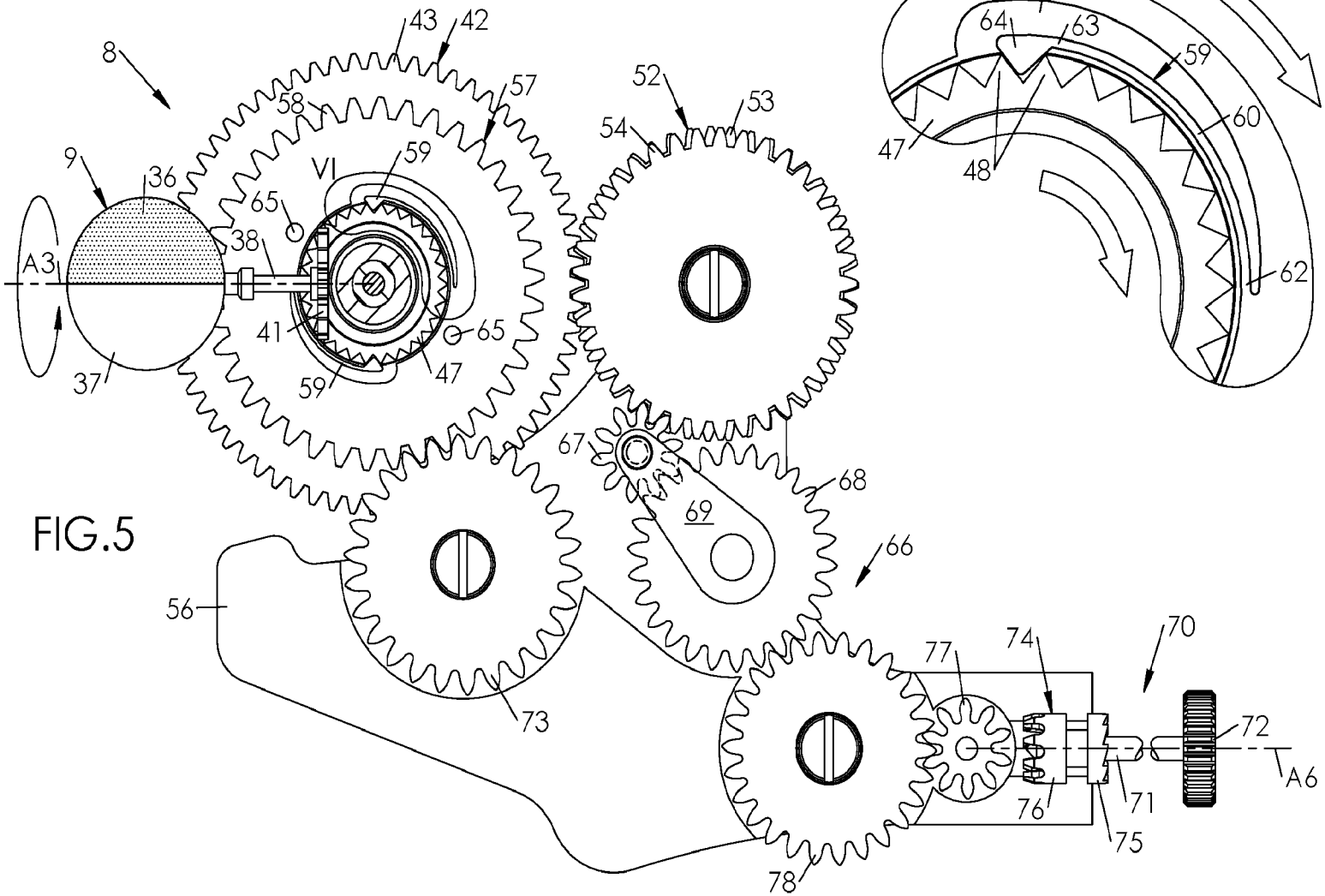
FIG. 5 is a plan view of the mechanism of FIG. 4 (to show the underlying components, the moon bearing has been removed).
Figure 7:
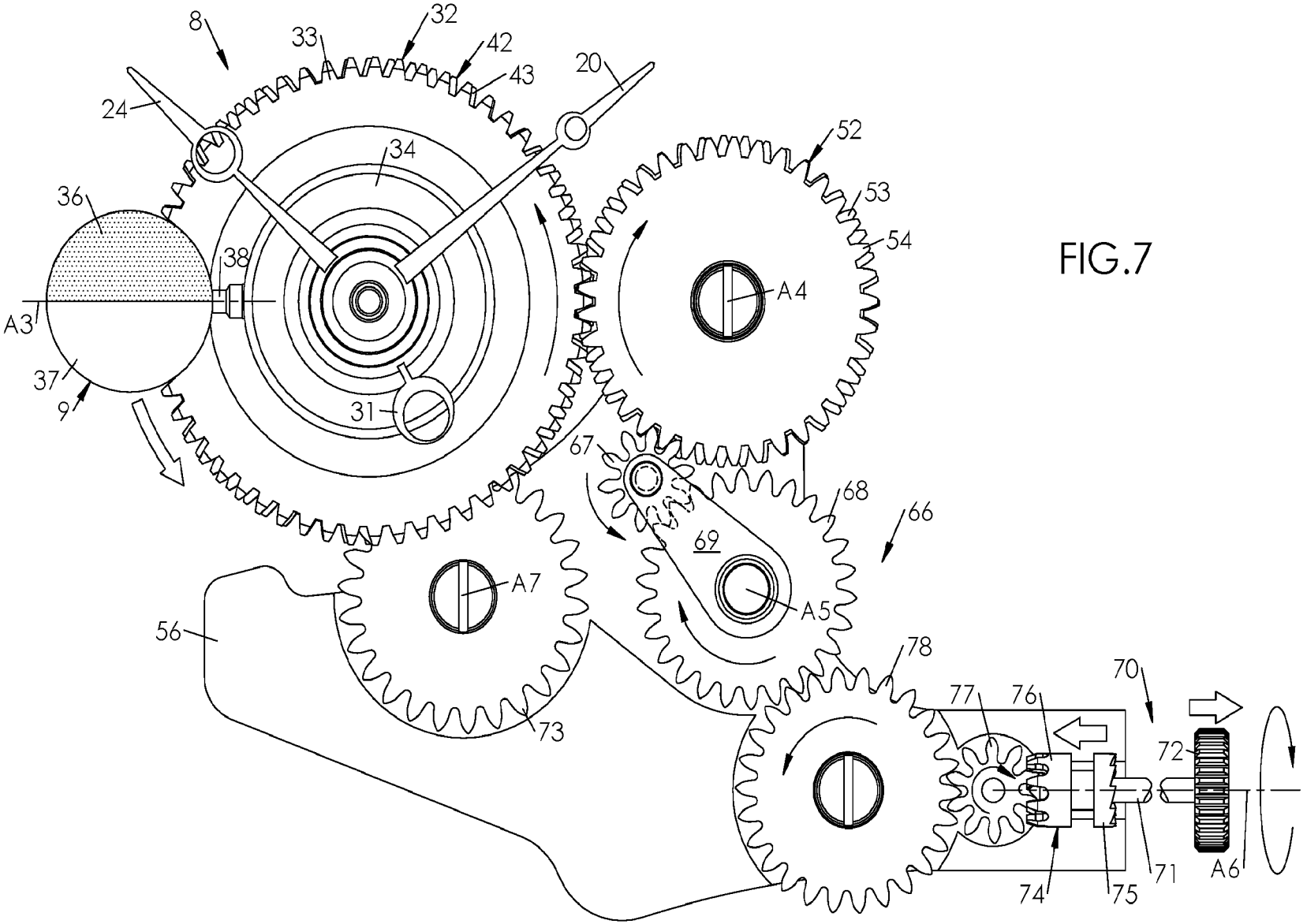
FIG. 7 is a top view of the mechanism, illustrating the lunar day correction.

However, in a preferred embodiment illustrated in the drawings, and more particularly in FIG. 5, FIG. 7 and FIG. 8, mechanism 8 includes a single device 66 for correcting the lunar day and moon phase display.

This correction device 66 includes a sliding pinion 67 able to adopt two adjustment positions, namely:

- a lunar day adjustment position, in which sliding pinion 67 meshes with moon wheel set 52 to force rotation of moon bearing 32 about main axis A1 via the first kinematic chain (FIG. 7);

a moon phase adjustment position, in which sliding pinion 67 meshes with transmission wheel 57 to force rotation of sphere 9 about radial axis A3 via the second kinematic chain (FIG. 8).

In the example illustrated in FIG. 7 and FIG. 8, correction device 66 includes a carrier pinion 68 which meshes with sliding pinion 67 and at least one connecting rod 69 which joins the axes of rotation of the sliding pinion and of the carrier pinion. In practice, correction device 66 includes a pair of superposed connecting rods 69, arranged on either side of the carrier pinion and the sliding pinion.

Carrier pinion 68 is rotatably mounted on bridge 56 about an axis A5 parallel to main axis A1 and advantageously materialized by a screw helically engaged with bridge 56.

Correction device 66 includes a winding mechanism 70 provided with a stem 71 mounted in a sliding pivot arrangement about and along a winding axis A6 perpendicular to main axis A1, and with a crown 72 integral in rotation with stem 71. The stem passes through case middle 3 and the crown is accessible to the user.

According to a particular embodiment illustrated in FIG. 8, correction device 66 includes a toothed, intermediate, phase wheel (hereinafter more simply referred to as intermediate phase wheel 73) which meshes with transmission wheel 57 and via which, in the moon phase adjustment position, sliding pinion 67 meshes with the transmission wheel. The intermediate phase wheel is rotatably mounted on the bridge about an axis A7 materialized by a screw helically engaged with bridge 56.

Correction device 66 also includes a sliding member 74 provided with a winding pinion 75 (for example with a Breguet toothing) and a sliding pinion 76, mounted in a sliding pivot arrangement about and along winding axis A6, and coupled to winding mechanism 70, for example by a traditional pull out piece and lever mechanism (not represented), between:

a correction position (FIG. 7 and FIG. 8) in which sliding pinion 76 is coupled to carrier pinion 68, and a position of release in which sliding pinion 76 is uncoupled from carrier pinion 68 (and in which winding pinion 75 is coupled to a winding pinion that is not represented, via which the mainspring of watch 1 is wound by rotating winding crown 72).

Transmission of the rotation of winding mechanism 70 to carrier pinion 68 is advantageously achieved via an intermediate train, which typically includes a first intermediate wheel 77, meshed with sliding pinion 76, and a second intermediate wheel 78, inserted between the first intermediate wheel and the carrier pinion.

Finally, in an embodiment illustrated in particular in FIG. 2 and FIG. 4, mechanism 8 includes a covering 79 in the form of a disc integral with moon bearing 32 (and for example sandwiched between meridian wheel 33 and moon cover 34). Covering 79 has an opening 80 of circular shape inside which is housed sphere 9. This covering, which rotates with moon bearing 32, is intended to symbolise the celestial vault. To this end, in the illustrated example, cover 79 carries symbols 81 (etched, painted, or in relief) representing a constellation of stars.

Correction of the lunar day display causes a rotation of sphere 9 about its axis A3 and consequently a change in the moon phase display. This is why correction of the lunar day display must precede correction of the moon phase display.

Prior to any correction, cam 74 must be placed in the correction position, by pulling (in a conventional manner for the user or watchmaker) winding crown 72, which pushes sliding pinion 76 towards first intermediate wheel 77 to place them in mesh.

To correct the lunar day display, winding crown 72 must be rotated in a determined direction which depends on the number of pinions in intermediate train 77, 78. In the embodiment illustrated in FIG. 7, the winding crown must be rotated in the clockwise direction seen along winding axis A6.

Rotation of winding crown 72 then drives, via intermediate train 77, 78, carrier pinion 68 in the clockwise direction (seen from above), which also tends to pivot connecting rods 69 in the clockwise direction and causes (or maintains) the meshing of sliding pinion 67 with moon wheel set 52.

The clockwise rotation of carrier pinion 68 then successively drives in rotation:

sliding pinion 67, meshed with carrier pinion 68, in the anticlockwise direction;

moon wheel set 52, meshed with sliding pinion 67, in the clockwise direction, moon bearing 32, whose meridian wheel 33 is meshed with upper wheel 54 of the moon wheel set, in the anticlockwise direction.

As a result, sphere 9 is driven in a movement of revolution about main axis A1 in the anticlockwise direction. All these movements are illustrated by the arrows in FIG. 7.

It will be noted that, during the lunar day correction, the resulting torque C2 which is exerted on auxiliary wheel 43 exceeds friction torque CF, such that, while first rotating element 25 remains rotationally immobile about axis A1 (since it is blocked by motion work 13), indent 46 yields and allows the auxiliary wheel to slide relative to pipe 27 at their interface 45.

The rotation of the winding crown 72 is stopped when the angular position of radial axis A3 of sphere 9 about main axis A1 is deemed to be correct, which ends the lunar day display correction.

The moon phase display must then be corrected. To do so, winding crown 72 must be rotated in the opposite direction to the direction followed during correction of the lunar day display. In the example illustrated in FIG. 8, winding crown 72 must be rotated in the anticlockwise direction seen from along winding axis A6.

The rotation of winding crown 72 drives, via intermediate train 77, 78, carrier pinion 68 in the anticlockwise direction (seen from above), which also tips connecting rods 69 in the anticlockwise direction until sliding pinion 67 meshes with intermediate phase wheel 73.

As the rotation of winding crown 72 continues, the anticlockwise rotation of carrier pinion 68 successively drives in rotation:

sliding pinion 67, meshed with carrier pinion 68, in the anticlockwise direction;

intermediate phase wheel 73, meshed with the sliding pinion, in the clockwise direction.

As soon as torque C2 attains jump torque CS (which the user or watchmaker's fingers are quite capable of causing to happen), transmission wheel 57, whose toothing 58 is meshed with intermediate phase wheel 73, is itself driven in rotation in the clockwise direction. All these movements are illustrated by the arrows in FIG. 8.

However, jump torque CS is lower than the friction torque CF of second rotating element 42 on first rotating element 25. Consequently, despite the rotation of transmission wheel 57, the second rotating element remains immobile, since it is integral in rotation with the first rotating element, which is locked by motion-work 13.

Consequently, the jumper or jumpers 59 is/are shifted radially and jump from one tooth to the next as transmission wheel 57 rotates, as illustrated in dotted lines in FIG. 9.

Central wheel 49, integral in rotation with transmission wheel 57, is driven, with its toothing 50, in rotation about axis A1 in the clockwise direction. As moon bearing 32 remains immobile, this rotation of the central wheel causes, via moon pinion 41 with which it meshes, rotation of sphere 9 about its radial axis A3, in the clockwise direction (seen from along axis A3).

In a first variant, by adding, for example, an additional wheel set to the moon phase correction train between the transmission wheel and the sliding pinion, the sphere then rotates in the anticlockwise direction, which corresponds to its direction of rotation in normal operation. In a second variant, assuming that, during a lunar day correction, sphere 9 is driven in a movement of revolution about main axis A1 in the clockwise direction, then the additional wheel set can be inserted in the kinematic chain of correction device 66. By way of alternative, in a third variant, one wheel set is removed from the kinematic chain of correction device 66. Finally, it is also possible to obtain a moon phase correction by reversing the relative position of the moon wheel set and the transmission wheel, the moon phase correction would then be made by rotating the crown in the clockwise direction, whereas the lunar day correction would be made by rotating the crown in the anticlockwise direction.

When star wheel 47 has 29 or 30 teeth, each jump of jumper spring(s) 59 from one tooth to the other corresponds to a correction of one day. When the star wheel has 59 teeth, each jump of the jumper spring(s) from one tooth to the other corresponds to a half-day correction. The wearer or watchmaker is informed of this correction (of one day or respectively a half-day) by the click sound that accompanies the jump of the jumper spring(s).

Once corrections to the lunar day display and the moon phase display are completed, the wearer pushes winding crown 72 back in, which moves cam 74 in translation, uncoupling sliding pinion 76 from first intermediate wheel 77.

During normal operation of watch 1, it is not inconvenient for sliding pinion 67 to remain meshed with moon wheel set 52 (as illustrated in FIG. 5) or with intermediate phase wheel 73, since winding mechanism 70 is uncoupled from carrier pinion 68.

It is seen that the correction device 66 presented above makes it possible, in a simple, efficient, precise and reliable manner, to correct the lunar day and moon phase in mechanism 8. For the wearer or the watchmaker, the direction of rotation alone determines the correction applied.

The invention claimed is:

1. A timepiece mechanism for displaying a lunar day and a moon phase, comprising:

a first rotating element rotatably mounted about a main axis and meshing with a drive mechanism;

a moon bearing provided with a meridian wheel and rotatably mounted about the main axis;

a sphere representing the moon, rotatably mounted relative to the moon bearing about a radial axis perpendicular to the main axis, the radial axis bearing a moon pinion;

a moon wheel set rotationally coupling, with gear reduction, the first rotating element to the meridian wheel;

a central wheel, rotatably mounted about the main axis on the first rotating element and meshing with the moon pinion;

a second rotating element, meshing with the moon wheel set and friction mounted, at an interface, on the first rotating element to rotate integrally therewith about the main axis while the torque resulting from various circumferential forces respectively exerted on the first rotating element and on the second rotating element is lower than a friction torque determining the maximum adhesion force at the interface, the second rotating element together with the moon wheel set and the moon bearing forming a first kinematic chain downstream of the first rotating element;

a transmission wheel, integral in rotation with the central wheel and provided externally with a toothing and internally with at least one jumper spring engaging and meshing with the toothing of a star wheel integral in rotation with the second rotating element, to rotationally couple said second rotating element to the central wheel while the torque resulting from various circumferential forces exerted respectively on the star wheel and on the transmission wheel) is lower than a jump torque, beyond which the jumper spring is radially shifted by sliding over the star wheel until it is disengaged therefrom, said at least one jumper spring and the star wheel being configured such that the jump torque is lower than said friction torque, the transmission wheel together with the central wheel and the moon pinion forming a second kinematic chain downstream of the star wheel;

a system for correcting the lunar day display, which includes a first drive element capable of having, at least momentarily, a meshing relationship with the first kinematic chain in order to force rotation of the moon bearing about the main axis, via a first correction train partially formed by at least one portion of the first kinematic chain, when a first correction torque, greater than said friction torque, is applied to said first correction train by a users; and a system for correcting the moon phase, which includes a second drive element capable of having, at least momentarily, a meshing relationship with said second kinematic chain in order to force rotation of the sphere about the radial axis, via a second correction train partially formed by at least one portion of the second kinematic chain and independent of the first kinematic chain, when a second correction torque, greater than said jump torque, is applied to said second correction train by a user.

2. The timepiece mechanism according to claim 1, wherein the lunar day display correction system and the moon phase correction system include a joint correction device for activating the lunar day display, and without activating the lunar day display, the moon phase, said joint correction device includes a sliding pinion which alone forms the first and second drive elements, said sliding pinion being able to adopt two adjustment positions including, a lunar day adjustment position, in which the sliding pinion meshes with the moon wheel set to force rotation of the moon bearing about the main axis via said at least one portion of the first kinematic chain, and a phase adjustment position, in which the sliding pinion meshes with the transmission wheel to force rotation of the sphere about the radial axis via said at least one portion of the second kinematic chain.

3. The timepiece mechanism according to claim 2, wherein the joint correction device includes a carrier pinion which meshes with the sliding pinion and at least one connecting rod which joins the axes of rotation of the sliding pinion and of the carrier pinion.

4. The timepiece mechanism according to claim 1, wherein the star wheel and the second rotating element are coaxial and integral and in that the transmission wheel and the central wheel are coaxial and integral.

5. The timepiece mechanism according to claim 1, wherein the first drive element is able to mesh with the moon wheel set at least during a correction of the lunar day display, and the second drive element is able to mesh with the transmission wheel at least during a correction of the moon phase.

6. The timepiece mechanism according to claim 1, wherein the first rotating element includes a toothed wheel which extends perpendicularly to the main axis, integral with a pipe that extends along the main axis.

7. The timepiece mechanism according to claim 6, wherein the second rotating element includes an auxiliary wheel which extends perpendicularly to the main axis, integral with a sleeve which is friction fitted onto the pipe of the first rotating element.

8. The timepiece mechanism according to claim 7, wherein the moon wheel set includes two superposed integral wheels, two superposed integral wheels including, a lower wheel, which meshes with the auxiliary wheel of the second rotating element, and an upper wheel, which meshes with the meridian wheel of the moon bearing.

9. The timepiece mechanism according to claim 8, wherein:

the auxiliary wheel of the second rotating element has 64 teeth, the lower wheel of the moon wheel set has 43 teeth, the upper wheel of the moon wheel set has 37 teeth, and the meridian wheel of the moon bearing has 57 teeth.

10. The timepiece mechanism according to claim 1, wherein the central wheel carries a crown toothing meshed with the moon pinion.

11. The timepiece mechanism according to claim 1, wherein the central wheel is mounted for free rotation on the first rotating element.

12. The timepiece mechanism according to claim 1, wherein the moon bearing is mounted for free rotation on the central wheel.

13. The timepiece mechanism according to claim 1, wherein the moon bearing is fitted onto the central wheel with insertion of a smooth bearing.

14. The timepiece mechanism according to claim 1, wherein the transmission wheel includes a pair of diametrically opposite jumper springs.

15. The timepiece mechanism according to claim 1, wherein the star wheel has 29, 30 or 59 teeth.

* * * * *